US012636568B2

(12) United States Patent
Durell et al.

(10) Patent No.: US 12,636,568 B2
(45) **Date of Patent: *May 26, 2026**

(54) PORTABLE SKI AND SNOWBOARD EDGE SHARPENER AND METHOD OF USING THE SAME

(71) Applicant: William E. Durell, Las Vegas, NV (US)

(72) Inventors: William E. Durell, Las Vegas, NV (US); Thomas E. Durell, Denver, CO (US)

( * ) Notice: Subject to any disclaimer, the term of this patent is extended or adjusted under 35 U.S.C. 154(b) by 1236 days.

This patent is subject to a terminal disclaimer.

(21) Appl. No.: 17/161,630

(22) Filed: Jan. 28, 2021

(65) Prior Publication Data

US 2021/0339114 A1 Nov. 4, 2021

Related U.S. Application Data

(63) Continuation of application No. 15/851,151, filed on Dec. 21, 2017, now Pat. No. 10,905,938, which is a continuation-in-part of application No. 14/804,490, filed on Jul. 21, 2015, now Pat. No. 9,878,415.

(60) Provisional application No. 61/999,259, filed on Jul. 22, 2014.

(51) Int. Cl.

| | |
|---|---|
| ***A63C 11/06*** | (2006.01) |
| ***B24B 3/00*** | (2006.01) |
| ***B24B 23/00*** | (2006.01) |
| ***B24B 27/00*** | (2006.01) |
| ***B24D 15/06*** | (2006.01) |

(52) U.S. Cl.

CPC ..... *A63C 11/06* (2013.01); *B24B 3/006* (2013.01); *B24B 27/0084* (2013.01); *B24D 15/066* (2013.01); *B24B 23/005* (2013.01)

(58) Field of Classification Search

CPC .. B24D 15/066; B24D 15/068; B24D 15/065; B24D 15/053; B24B 3/006; B24B 3/003; B24B 23/004; B24B 21/002

USPC ..... 451/344, 349, 383

See application file for complete search history.

(56) References Cited

U.S. PATENT DOCUMENTS

| | | | |
|---|---|---|---|
| 2,238,704 | A | 4/1941 | Miller |
| 2,821,815 | A | 2/1958 | Banko |
| 2,926,461 | A | 3/1960 | Banko |
| 3,159,951 | A | 12/1964 | Winbauer |
| 3,512,308 | A | 5/1970 | Schell, Jr. |
| 3,755,971 | A | 9/1973 | Garcia |
| 3,881,280 | A | 5/1975 | Thompson |
| 4,022,182 | A | 5/1977 | Lenkevich |

(Continued)

*Primary Examiner* — Makena S Markman
(74) *Attorney, Agent, or Firm* — Clark Hill PLC

(57) ABSTRACT

A ski or snowboard edge sharpener may include an abrasive grinding wheel, a belt-driven drive train or direct drive system that connects a motor and grinding wheel drive mechanism and decreases the grinding wheel's speed of rotation relative to the speed of the motor, a grinding wheel mount allowing selection and use grinding wheels of different grits and materials and grinding wheel controls allowing the control of the cut depth and the grinding wheel angles relative to the longitudinal and transverse planes of the ski edge surface to be sharpened. In some embodiments, the sharpener may alternatively include a grinding wheel and motor that drives the grinding wheel drive mechanism. Such configurations may allow repeated sharpening of a ski edge at specific/chosen angles with a specific/chosen surface finish. A position lockdown device that is part of each of the control mechanisms may be included.

24 Claims, 11 Drawing Sheets

(56) References Cited

U.S. PATENT DOCUMENTS

| | | | |
|---|---|---|---|
| 4,241,544 | A | 12/1980 | Hampton |
| 4,294,043 | A | 10/1981 | Sakcriska |
| 4,665,778 | A | 5/1987 | Lubin et al. |
| 4,679,356 | A | 7/1987 | Thomas |
| 4,934,108 | A | 6/1990 | Hall |
| 6,086,465 | A | 7/2000 | Mayr |
| 6,093,090 | A | 7/2000 | Tosto et al. |
| 6,123,611 | A | 9/2000 | Lawrence, Jr. |
| 6,332,836 | B1 | 12/2001 | Tseng |
| 6,702,656 | B1 | 3/2004 | Hibbert |
| 6,761,623 | B1 | 7/2004 | Baker |
| 6,805,622 | B1 | 10/2004 | Dorner |
| 6,953,394 | B2 | 10/2005 | Wendt et al. |
| 7,114,413 | B1 | 10/2006 | Behan |
| 7,530,879 | B2 | 5/2009 | Wagner et al. |
| 7,699,687 | B2 | 4/2010 | Nordstrom |
| 7,967,666 | B1 | 6/2011 | Messner |
| 8,162,726 | B1 | 4/2012 | Jorgnsen |
| 8,523,637 | B2 | 9/2013 | Loveless et al. |
| 8,616,938 | B1 | 12/2013 | Mills |
| 9,102,031 | B2 | 8/2015 | Page |
| 9,517,543 | B2 | 12/2016 | Proulx |
| 2006/0286910 | A1 | 12/2006 | Voigt et al. |
| 2009/0088052 | A1 | 4/2009 | Whelan |
| 2010/0330889 | A1 | 12/2010 | Thibault |
| 2014/0335764 | A1 | 11/2014 | Brown et al. |
| 2014/0352106 | A1 | 12/2014 | King, Jr. |

PORTABLE SKI AND SNOWBOARD EDGE SHARPENER AND METHOD OF USING THE SAME

CROSS-REFERENCE TO RELATED APPLICATIONS

This is a continuation of application Ser. No. 15/851,151, filed Dec. 21, 2017, published as US2018/0111037A1, now U.S. Pat. No. 10,905,938, which is a continuation-in-part of U.S. application Ser. No. 14/804,490, filed on Jul. 21, 2015, now U.S. Pat. No. 9,878,415, which claims the benefit of and priority to U.S. provisional patent application No. 61/999,259 filed Jul. 22, 2014, which are all hereby incorporated by reference in their entirety.

BACKGROUND OF THE INVENTION

1. Field

The embodiments of the present invention generally relate to a device that offers a portable method for sharpening ski and snowboard edges in the field as well as in the shop.

2. Description of the Related Art

Sharp metal edges are required to maximize the performance potential of a ski. The frequency and quality of edge sharpening is generally geared to the requirements of the ski and skier as well as the conditions they typically encounter. Soft, natural snow does not require particularly sharp edges, nor does it tend to dull a ski's edges very quickly when skied upon. Conversely, hard, man-made snow and water-injected race courses require very sharp ski edges and also cause ski edges to dull relatively quickly.

Depending on the skier's skill level and preference, and local conditions, the skier may choose to sharpen the ski edge to less than 90 degrees to increase the performance of the ski. The angle generally falls between 85 and 89 degrees depending upon the type of skis, the anticipated hardness of the snow and the skier's skill level and preference.

Precise repeatability and accuracy is desirable in any ski sharpening tool, but especially those used by experts and racers who may have several pairs of skis that are sharpened frequently. In such cases, the edge angle, sharpness and finish applied to the ski edge by the sharpening tool must be as close in quality and accuracy as the last sharpening, and be consistent between edges and across skis in order to provide the skier with the expected uniformity and performance level.

Most current models of powered ski edge sharpeners require a plug-in electrical source which limits their use to an area where an electrical outlet is available, have limited repeatability and accuracy, are relatively expensive or have some combination of these drawbacks.

Thus, it would be advantageous to develop a new ski edge sharpener for overcoming the aforementioned drawbacks and others.

SUMMARY

A ski edge sharpener according to the embodiments of the present invention comprises an abrasive grinding wheel (precision made and super abrasive in one embodiment), a belt driven drive train that connects the electric motor and the grinding wheel drive mechanism and decreases the grinding wheel's speed of rotation relative to the rotational speed of the motor, a grinding wheel mount allowing the operator to select and use grinding wheels of different grits and materials and grinding wheel control mechanisms allowing the operator to control the depth of cut and the grinding wheel angles relative to the longitudinal and transverse planes of the ski edge surface to be sharpened. This configuration allows the operator to repeatedly sharpen a ski edge at a specific and chosen angle with a specific and chosen surface finish. In one embodiment, position lock-down devices are a part of each of the control mechanisms. In another embodiment, the ski edge sharpener also includes a vacuum system to capture residue from the grinding operation. Advantageously, the ski edge sharpener described herein is a battery-operated, rechargeable device providing portability which prior art plug-in devices lack.

In one embodiment, a sharpener for a ski or snowboard may include a case, a motor for driving said grinding wheel, a motor shaft engaged with said motor, an arbor engaged with said motor shaft, a grinding wheel engaged with said arbor, and an edge guide for guiding an edge of a subject ski or snowboard into contact with said grinding wheel.

In another embodiment, a direct drive sharpener for a ski or snowboard may include a case, a motor for driving said grinding wheel, a motor shaft engaged with the motor, a grinding wheel connected with said motor via said motor shaft, an edge guide for guiding an edge of a subject ski or snowboard into contact with said grinding wheel, and a controller for powering said motor.

In still another embodiment, a sharpener for a ski or snowboard may include a motor for driving said grinding wheel, a motor shaft engaged with the motor, an arbor engaged with the motor shaft, a grinding wheel engaged with the arbor, an edge guide for guiding an edge of a subject ski or snowboard into contact with said grinding wheel, and a controller for providing power to the motor.

Other variations, embodiments and features of the present invention will become evident from the following detailed description, drawings and claims.

DETAILED DESCRIPTION

Figure 1:
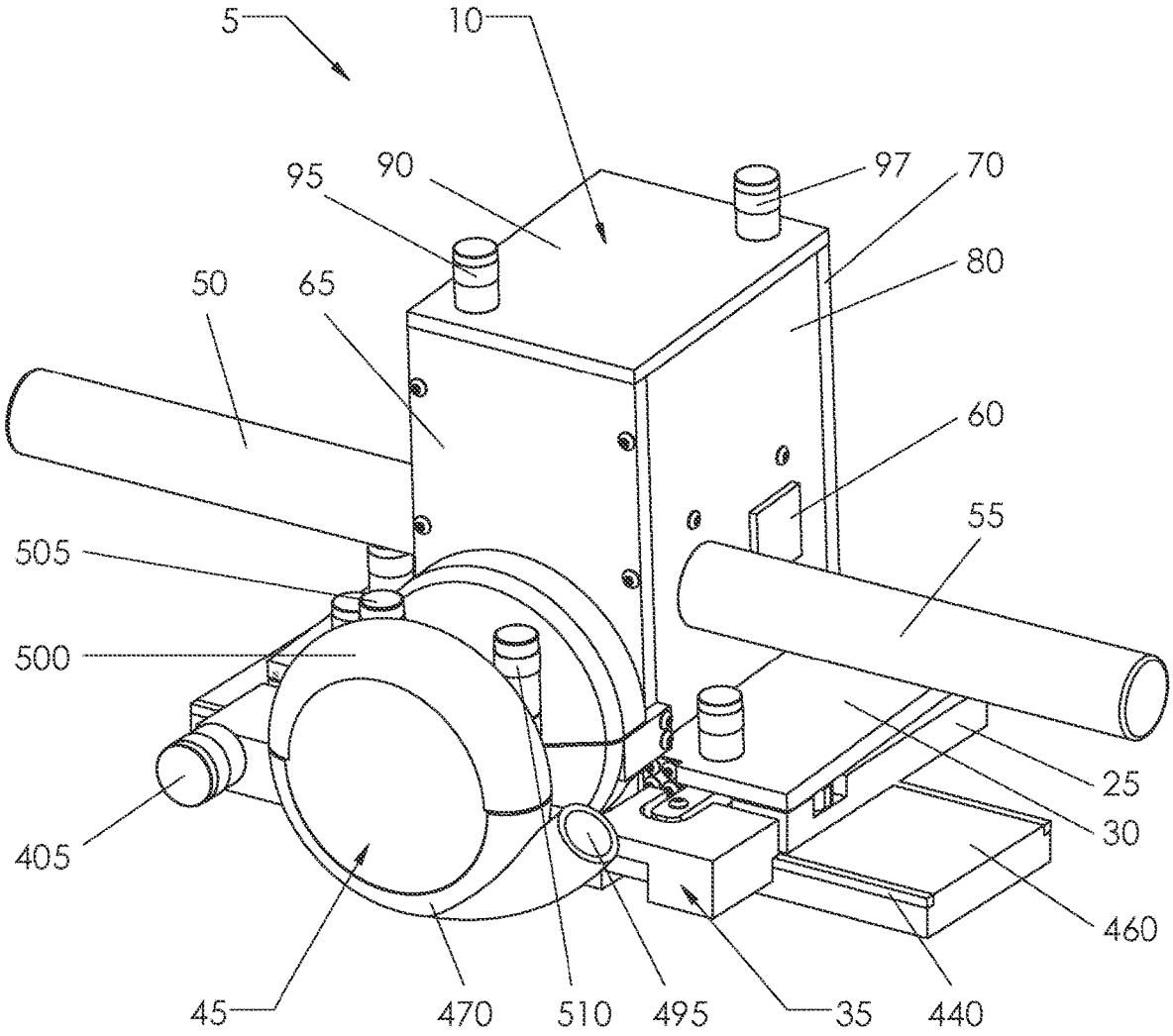
FIG. 1 illustrates an isometric view of an overall ski edge sharpener, according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The term 'ski' as used herein refers to any ski or snowboard with metal (or other) edges designed to be sharpened. The term 'skier' as used herein refers to the user of the skis or snowboard. The term 'operator' as used herein refers to the user of the ski edge sharpener. The components of the ski edge sharpener may be made of any suitable material including, but not limited to, metals, alloys, composites, polymers and combinations thereof. The components of the ski edge sharpener may be fabricated using any suitable technique including, but not limited to, molding, casting, machining, additive processes and combinations thereof.

Figure 2:
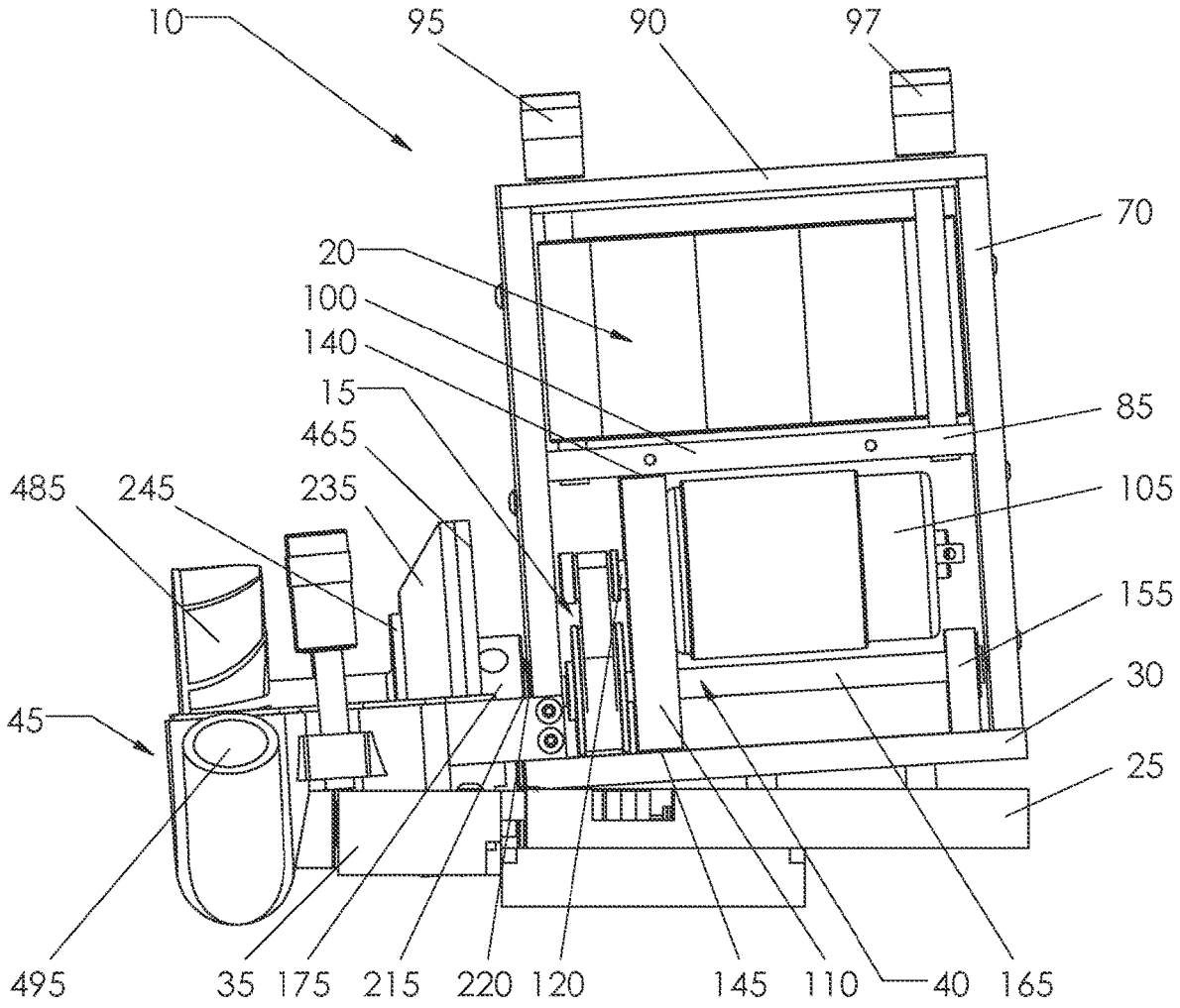
FIG. 2 illustrates a right side view of the ski edge sharpener of FIG. 1 with the drive and battery case right plate, right handle, the top wheel guard and vacuum cover, switch and right edge guide lock down screw removed for observing internal aspects of the ski edge sharpener, according to the embodiments of the present invention.

With reference to the Figures, for example, FIGS. 1 and 2, one embodiment of a ski edge sharpener may be shown by ski edge sharpener 5, which comprises a drive and battery case 10, drive assembly 15, battery pack assembly 20, base plate 25, tilt plate assembly 30, edge guide assembly 35, arbor assembly 40, grinding wheel guard and vacuum assembly 45, handles 50 and 55, and on-off switch 60.

Drive and battery case or housing 10 comprises a drive and battery case front plate 65, drive and battery case rear plate 70, drive and battery case left plate 75, drive and battery case right plate 80, drive case top plate 85 and battery case top cover 90. Drive and battery case plates 65, 70, 75, 80 and drive case top plate 85 are rigidly affixed to one another. The case may completely or partially contain the components, such as the drive assembly 15, battery pack assembly 20 and motor 105, etc. Battery case top cover 90, which affords easy access for replacement or charging battery pack assembly 20, is attached to the top of drive and battery case 10 by top cover attachment screws 95 and 97.

Battery pack assembly 20 sits on top of drive case top plate 85. Two wires (not shown) pass from battery pack assembly 20 through wire hole 100 in drive case top plate 85 and connect to motor 105. One of the wires (not shown) is connected in series through on-off switch 60 prior to connecting to motor 105. On-off switch 60, when in the on position, completes the electric circuit from battery pack assembly 20 to motor 105.

Figure 3:
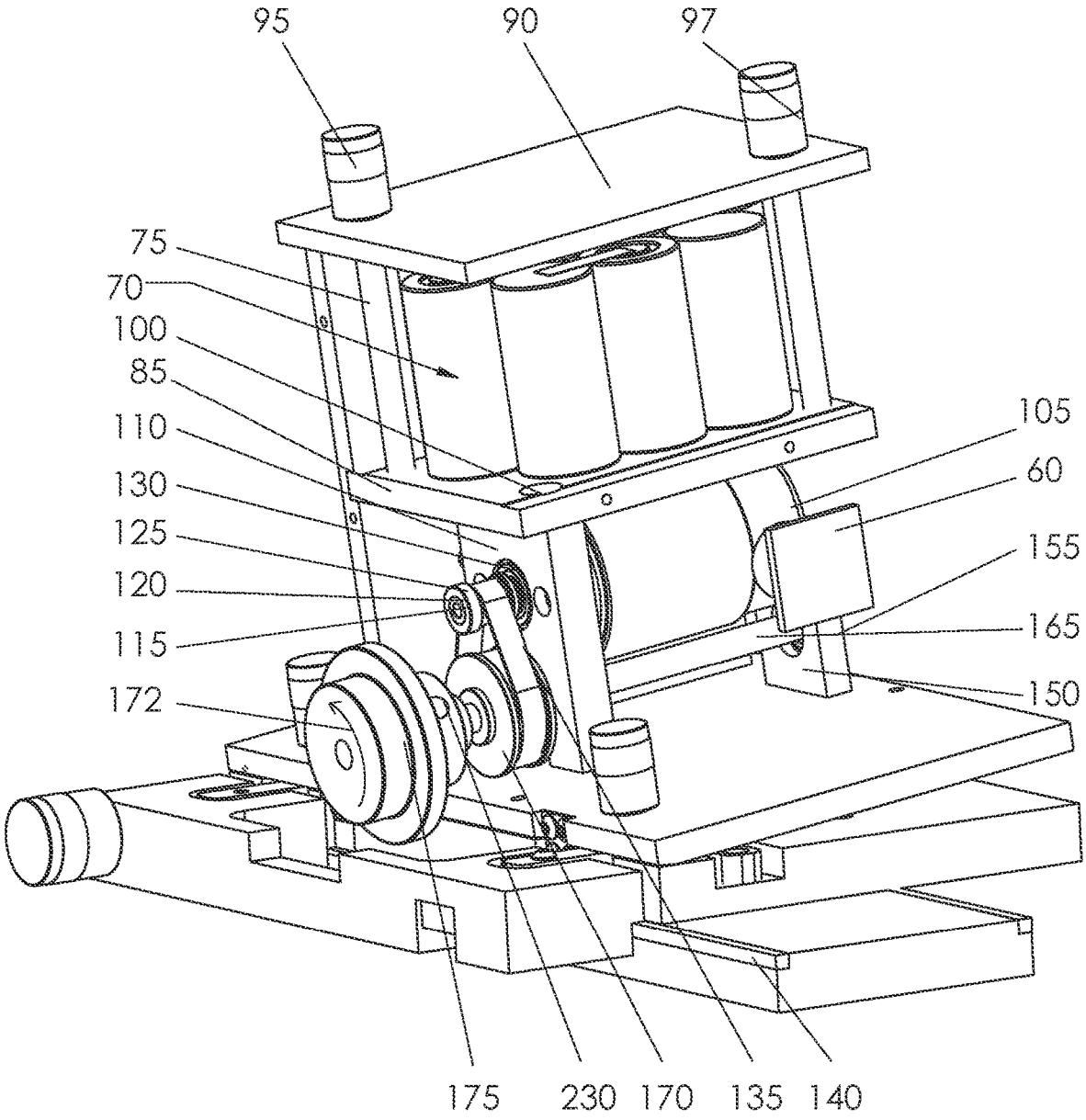
FIG. 3 illustrates a right front side isometric view of the ski edge sharpener of FIG. 1 with the drive and battery case rear plate, right plate and front plate, grinding wheel guard and vacuum assembly, grinding wheel and right handle removed for observing internal aspects of the ski edge sharpener according to the embodiments of the present invention.
Figure 4:
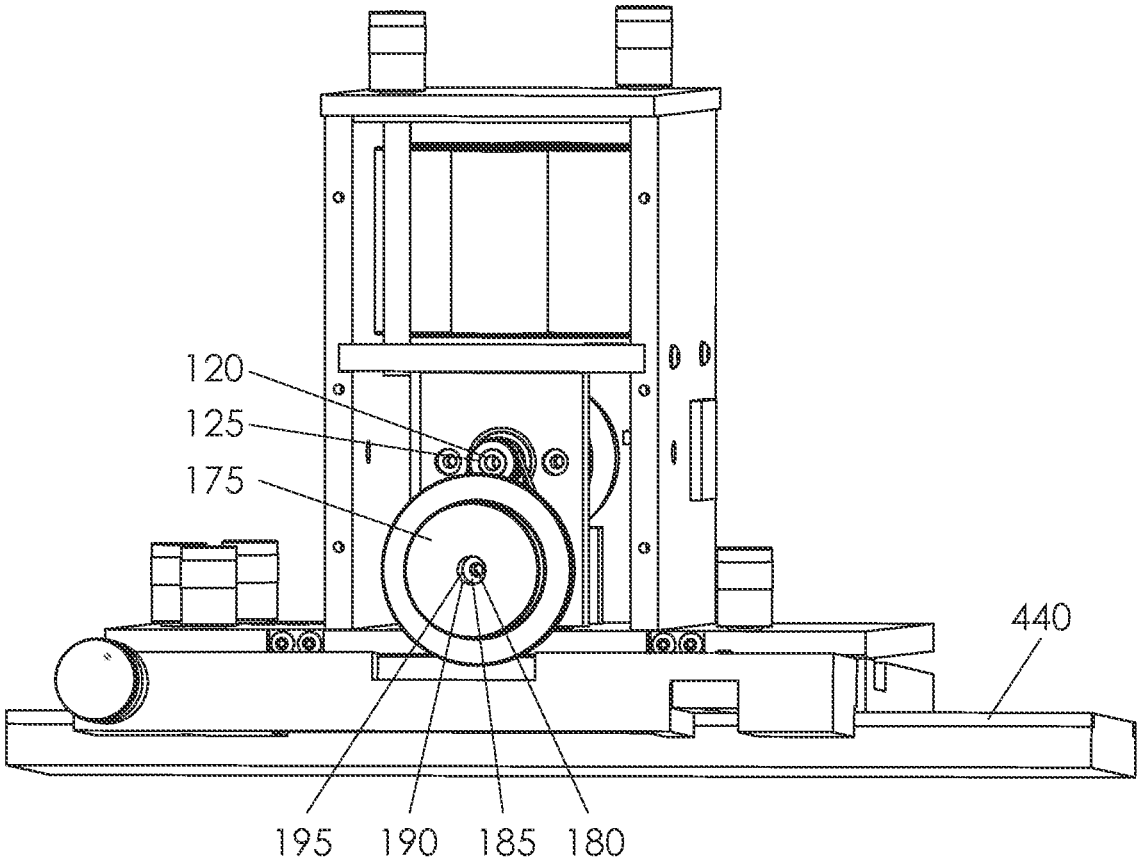
FIG. 4 illustrates a right front isometric view of the ski edge sharpener of FIG. 1 with the drive and battery case front plate, grinding wheel guard, vacuum assembly and right handle removed for observing internal aspects of the ski edge sharpener, according to the embodiments of the present invention.
Figure 5:
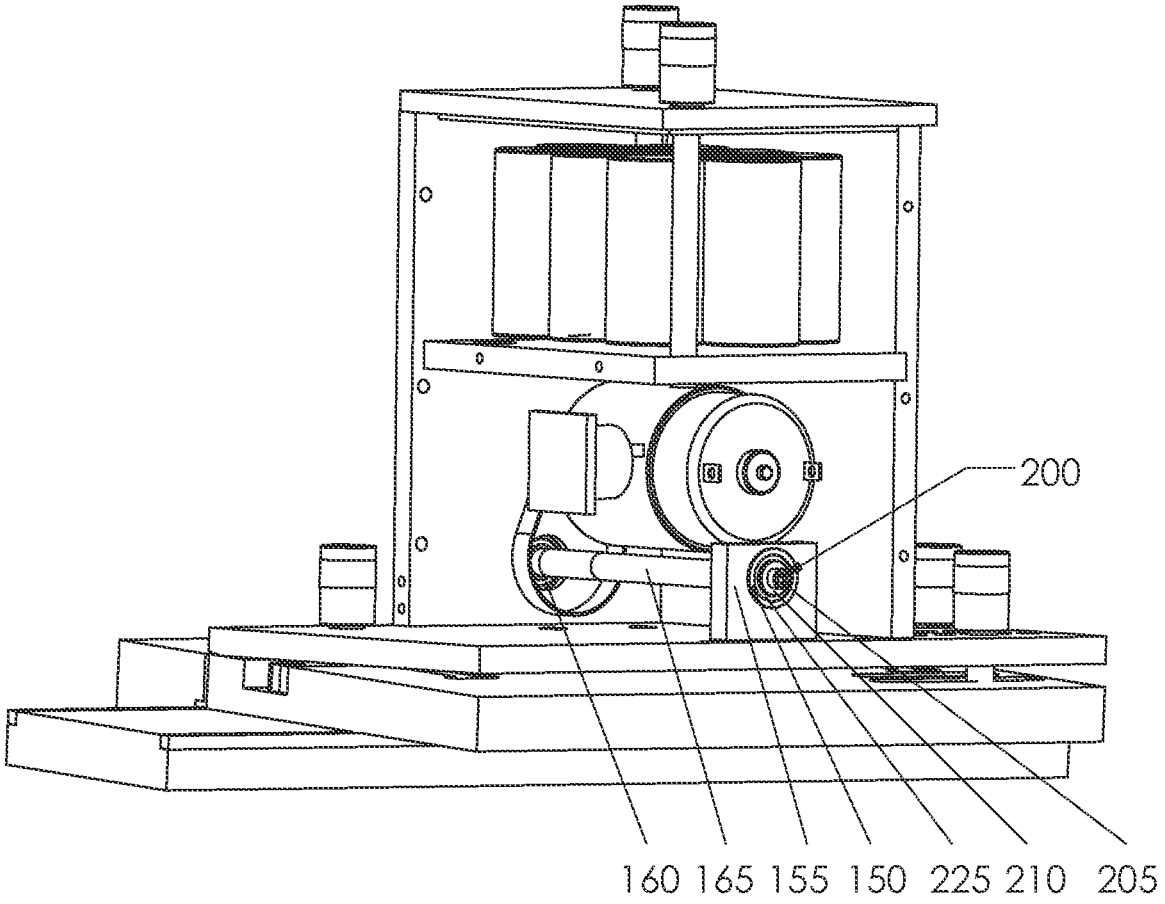
FIG. 5 illustrates a right rear isometric view of the ski edge sharpener of FIG. 1 with the drive and battery case rear plate and right plate, motor mount and right handle removed for observing internal aspects of the ski edge sharpener, according to the embodiments of the present invention.

Now referring to FIGS. 2-4 which each show internal aspects of the ski edge sharpener 5, motor 105 is rigidly attached to motor mount 110. Attached to the motor shaft (not shown) is motor shaft bushing 120. Attached to motor shaft bushing 120 is motor pulley 125. Motor mount bearing 130 is press fit into motor mount 110. Motor shaft bushing 120 passes through and is supported by motor mount bearing 130 which absorbs transverse loads placed on motor shaft 115 by drive belt 135, preventing the transverse loads from being placed on the motor shaft internal bushing (not shown). 'O' rings (not shown) are placed in recesses (not shown) along motor mount top surface 140 and motor mount bottom surface 145. Such an arrangement allows for vibration dampening caused by the rotation of motor 105.

As best shown in FIG. 3, rear bearing 150 is press fit into arbor shaft rear bearing support 155. Front bearing 160 is press fit into drive and battery case front plate 65. Arbor shaft 165 is supported by rear bearing 150 and front bearing 160. Attached to arbor shaft 165 is arbor pulley 170. Drive belt 135 goes around motor pulley 125 and arbor pulley 170 and transmits the counter-clockwise rotational drive, as depicted by arrow 172, from motor 105 to arbor pulley 170. The counter-clockwise rotational speed difference between motor 105 and arbor shaft 165 is controlled by the relative size differences between motor pulley 125 and arbor pulley 170.

As best shown in FIG. 4, arbor 175 is mounted on arbor shaft 165. Arbor front bolt 180 passes through arbor washer 185 and threads into arbor shaft proximal end 190. Arbor washer 185 presses against arbor inner shoulder 195. At arbor shaft distal end 200, arbor shaft rear bolt 205 passes through arbor shaft rear washer 210 and threads into arbor shaft distal end 200. The tightening of the arbor shaft rear bolt 205 causes arbor outer shoulder 215 to come in contact with front bearing inner race 220 and arbor shaft rear washer 210 to come in contact with rear bearing inner race 225. Additional tightening of the arbor shaft rear bolt 205 causes bearing inner races 220 and 225 to be drawn toward one another thereby removing any horizontal movement in arbor shaft 165. When all undesirable horizontal movement in arbor shaft 165 has been removed, the adjustment is complete. Once horizontal movement of arbor shaft 165 is eliminated, arbor 175 is then rigidly affixed to arbor shaft 165 by arbor set screw 230. Grinding wheel 235 is then rigidly attached to arbor 175 by grinding wheel attachment bolt 240 passing through fender washer 245 and screwing into arbor 175.

Figure 7:
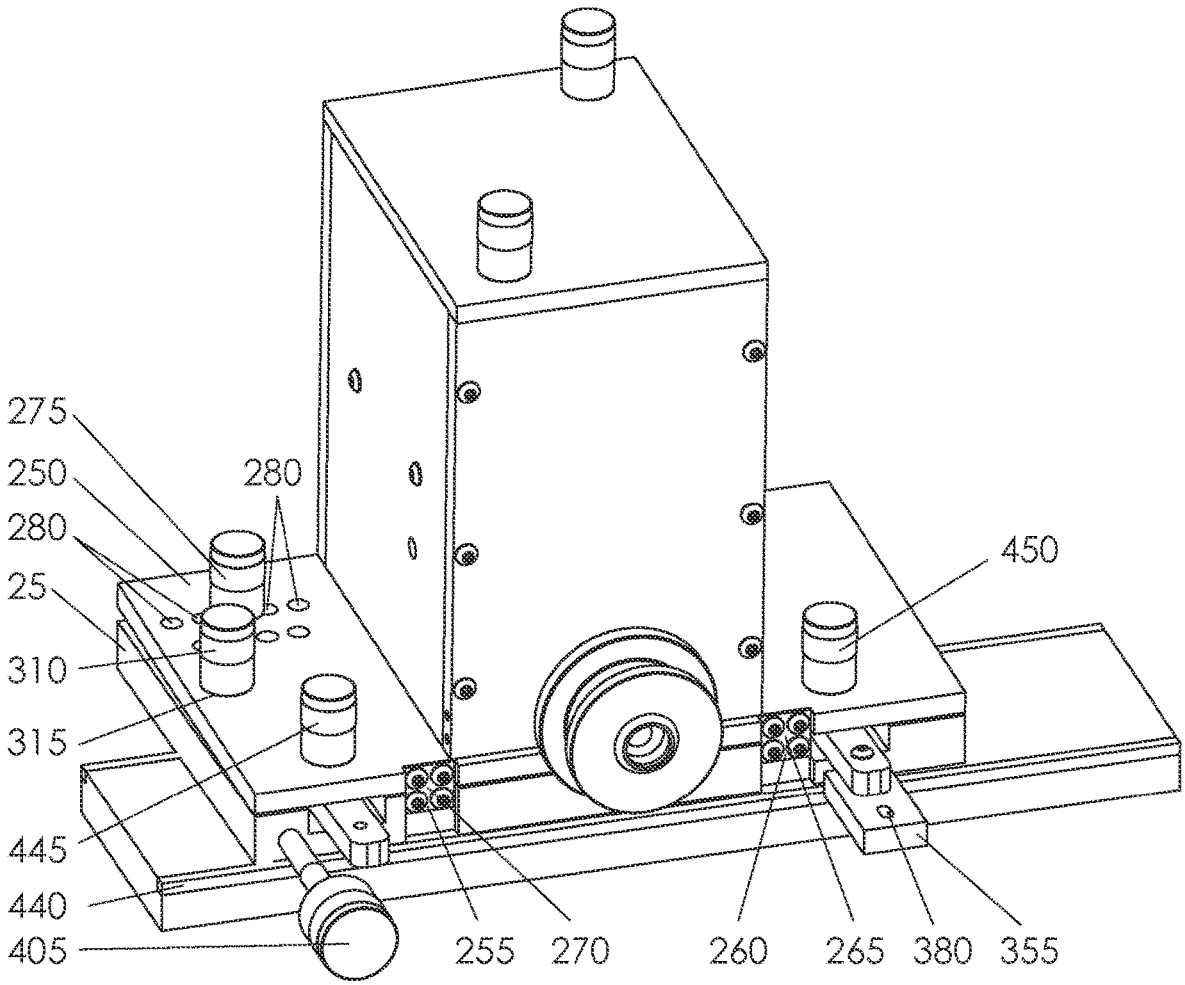
FIG. 7 illustrates a left front isometric view of the ski edge sharpener of FIG. 1 with the edge guide, grinding wheel guard and vacuum assembly, grinding wheel and left and right handles removed for observing internal aspects of the ski edge sharpener, according to the embodiments of the present invention.

Now referring to FIG. 7, tilt plate 250 is connected to base plate 25 by leaf spring hinges 255 and 260. Leaf spring hinges 255 and 260 are rigidly attached to tilt plate 250 and rigidly attached to base plate 25. With such an arrangement, tilt plate 250 is rigidly attached to base plate 25 except for rotational movement allowed by leaf spring hinges 255 and 260 around leaf spring hinge flex points 265 and 270.

Figure 8:
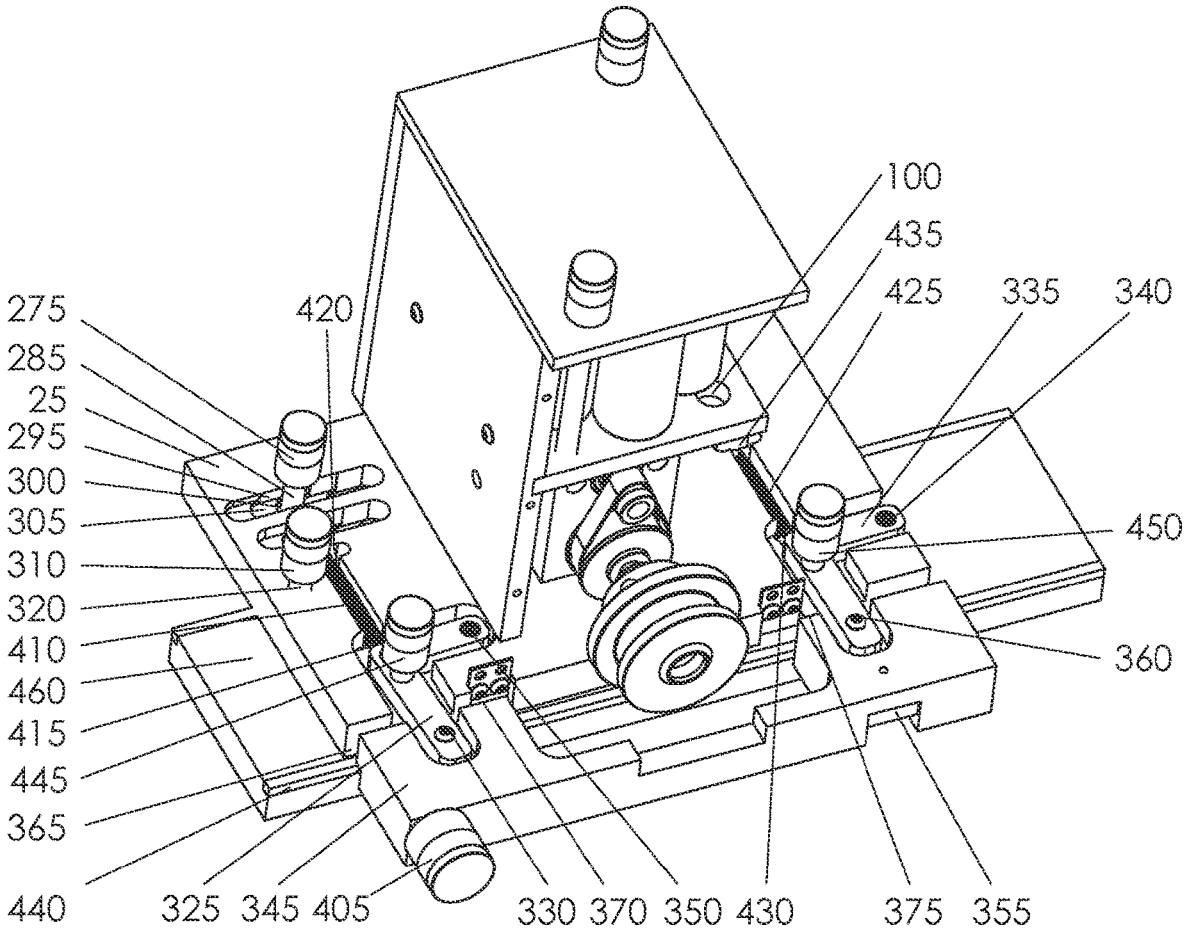
FIG. 8 illustrates a left front isometric view of the ski edge sharpener of FIG. 1 with the tilt plate, gear and battery case front and right plates, grinding wheel guard and vacuum assembly and left and fight handles removed for observing internal aspects of the ski edge sharpener, according to the embodiments of the present invention.

As best shown in FIG. 8, left edge guide hinge 325 is attached to base plate 25 by left edge guide hinge retaining screw 330. Right edge guide hinge 335 is attached to base plate 25 by right edge guide hinge retaining screw 340. In one embodiment, left edge guide hinge 325 and right edge guide hinge 335 are identical. Left edge guide hinge 325 is attached to edge guide 345 by left edge guide hinge retaining screw 350. Right edge guide hinge 335 is attached to edge guide slide 355 by right edge guide hinge retaining screw 360. Left edge guide hinge 325 is allowed to rotate around retaining screws 330 and 350. Right guide hinge is allowed to rotate around retaining screws 340 and 360. Based on this arrangement, the fixed angle between base plate surface 365 and edge guide surfaces 370 and 375, which are coplanar with each other, remains constant throughout the range of motion of edge guide 345.

The angle between base plate surface 365 and edge guide surfaces 370 and 375 can be adjusted by changing the position of edge guide slide 355 in edge guide slot 380. This adjustment is held in place by edge guide slide adjustment screw 385 passing through slot 390 in edge guide slide 355 and threading into edge guide 345.

Figure 9:
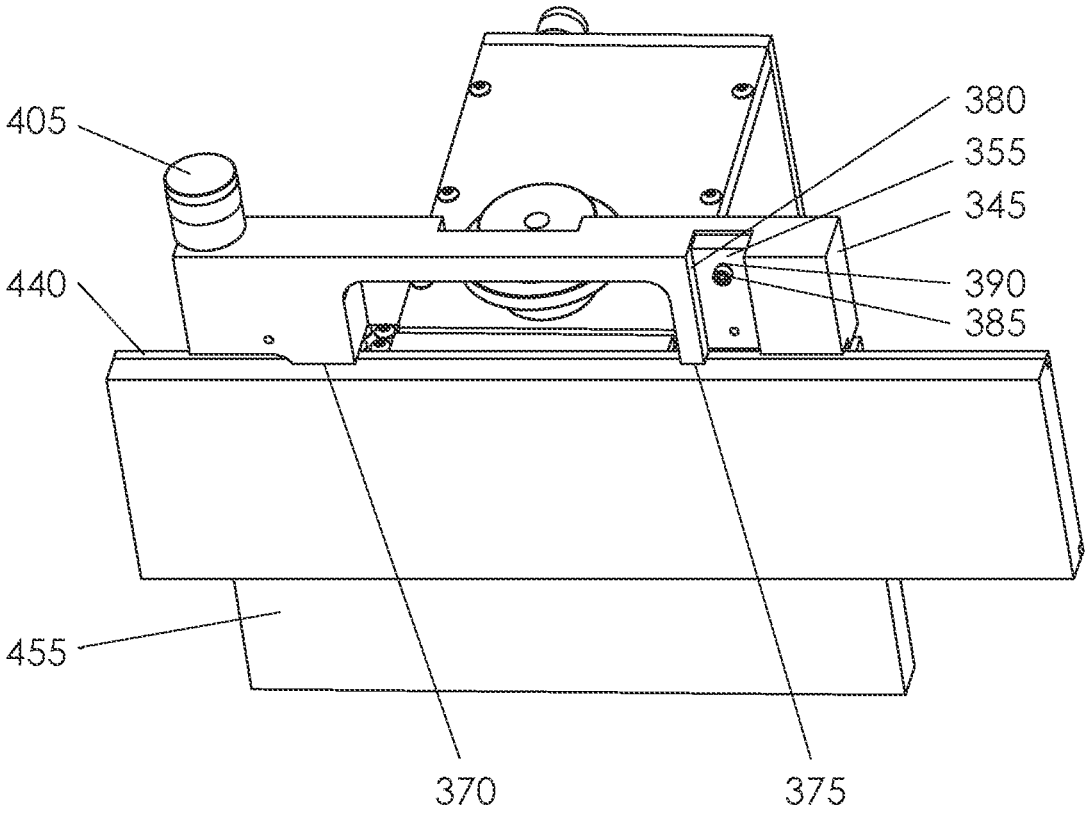
FIG. 9 illustrates a right front bottom isometric view of the ski edge sharpener of FIG. 1 with the grinding wheel, grinding wheel guard and vacuum assembly, and left and right handles removed for observing internal aspects of the ski edge sharpener, according to the embodiments of the present invention.

Now referring to FIG. 9, edge guide adjustment screw 405 is threaded through edge guide 345 and contacts base plate surface 365. Adjusting edge guide adjustment screw 405 moves edge guide 345 toward or away from base plate 25. Left hinge return spring 410 is attached to left edge guide hinge 325 at 415 and to base plate 25 at 420. Right hinge return spring 425 is attached to right edge guide hinge 335 at 430 and to base plate 25 at 435. Hinge return springs 410 and 425 pull edge guide hinges 325 and 335, respectively, closing the gap between edge guide surfaces 370 and 375 and base plate surface 365. Edge guide adjustment screw 405 works against the pull of return springs 410 and 425 giving edge guide adjustment screw 405 control over the distance between edge guide surfaces 370 and 375 and base plate surface 365. This adjustment controls the depth of cut grinding wheel 235 will make on ski edge 440. When edge guide 345 is in the proper position, both left edge guide hinge clamp screw 445 and right edge guide hinge clamp screw 450 are tightened locking edge guide 345 into the selected position.

In operation, grinding wheel 235 can be tilted from a vertical orientation by tilt adjustment screw 275 and locked in the selected tilt position by tilt plate lock down screw 310. Grinding wheel 235 can be rotated horizontally in relation to ski edge 440 by adjusting the location of edge guide slide 355. The cut depth of grinding wheel 235 on ski edge 440 can be adjusted by adjusting edge guide adjustment screw 405 and locked in the selected cut depth position by edge guide clamp screws 445 and 450.

Figure 6:
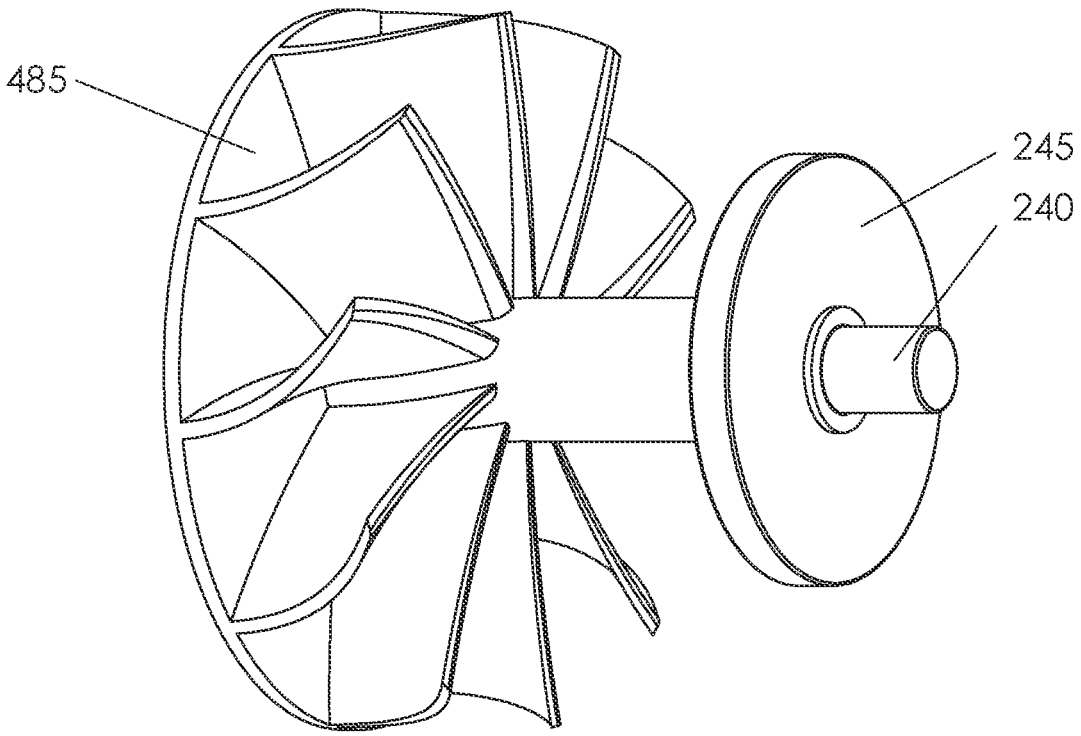
FIG. 6 illustrates an isometric view of the fan assembly of a ski edge sharpener, according to the embodiments of the present invention.

Surrounding grinding wheel 235 is grinding wheel guard and vacuum assembly 45. Grinding wheel guard and vacuum assembly lower section 470 is rigidly attached to drive and battery case front plate 65. As best shown in FIG. 6, inserted into the end of fan 485 is grinding wheel attachment bolt 240 which passes through fender washer 245 and screws into arbor 175, thus securing both grinding wheel 235 and fan 485 in place. Since fan 485 and grinding wheel 235 are attached to each other, they rotate together. The rotation and design of fan 485 creates a vacuum around grinding wheel 240 and expels air through grinding wheel guard assembly 45 and out nozzle 495. The air flowing around grinding wheel 235 and into grinding wheel guard assembly 45 captures the residue from the grinding operation and expels it out through nozzle 495 into an attached collection bag (not shown). Grinding wheel guard and vacuum assembly upper section 500, when attached to grinding wheel guard and vacuum assembly lower section by grinding wheel guard and vacuum assembly hold down screws 505 and 510, close the grinding wheel guard and vacuum assembly. Removing grinding wheel guard and vacuum assembly upper section 500 by loosening upper section hold down screws 505 and 510 gives access to fan 485 and grinding wheel 235. Unscrewing fan 485 from grinding wheel 235 allows for the removal and replacement of grinding wheel 235.

In operation, tilt adjustment screw 275 is placed in the desired tilt adjustment hole 280 and seated. Tilt plate lock down screw 310 is then seated in a hole of tilt plate lockdown 315 thereby fixing the tilt angle of tilt plate 250 in relation to base plate 25. Adjusting the position of edge guide slide 355 fixes the horizontal angle between edge guide surfaces 370 and 375 and base plate surface 365. Adjusting edge guide adjustment screw 405 determines the depth of cut of grinding wheel 235. With the ski bottom surface 460 facing up and held in a horizontal position, the bottom surface 455 of base plate 25 slides along the ski bottom surface 460, edge guide surfaces 370 and 375 contact and slide along ski edge 440, and grinding wheel surface 465 is in contact with ski edge 440 at the proper vertical and transverse angles and at the proper depth. Handles 50 and 55 allow the operator to easily grip ski edge sharpener 5 during operation.

Because of the counter-clockwise-direction of rotation of grinding wheel 235, grinding induced burr creation has been and is greatly reduced. The absence of burrs reduces friction generated by the ski edge contacting the snow or ice and prevents jagged sections on the ski edges from forming when a burr breaks or chips off during ski use. In addition, the grinding wheel rotational speed, grinding wheel grit size and grinding wheel material combine to surface harden ski edge 440, thus prolonging and reducing the action of the snow or ice in dulling the edge sharpness. While counter-clockwise rotation is shown to greatly reduce grinding induced burrs, it is conceivable that in other embodiments, clockwise rotation may be used.

Figure 10:
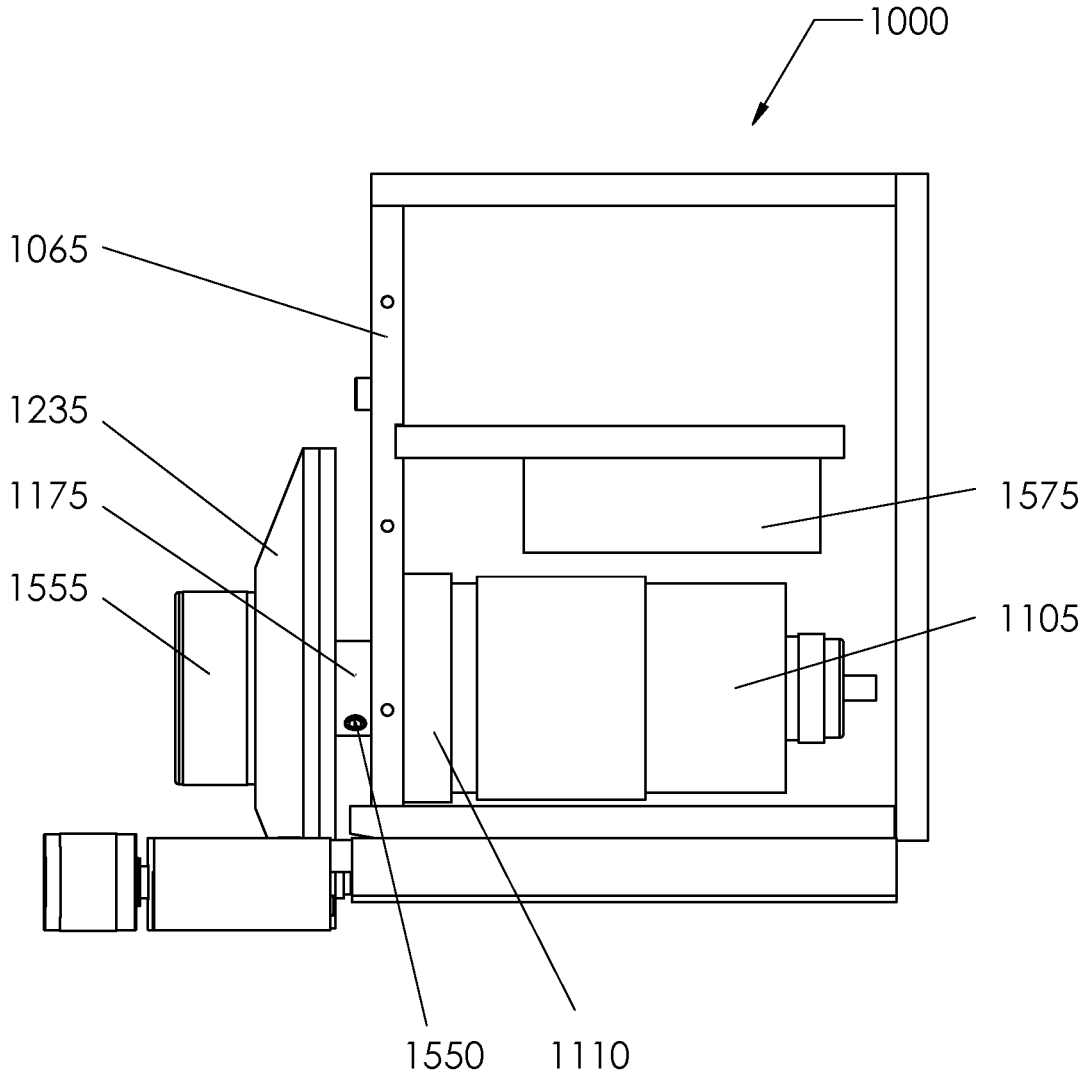
FIG. 10 illustrates a left side view of a ski edge sharpener with a left side plate, handles, battery, and wheel guard removed for clarity, according to the embodiments of the present invention.
Figure 11:
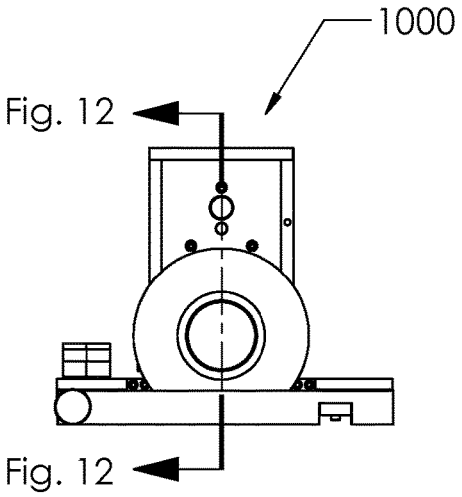
FIG. 11 is a front view of the ski edge sharpener of FIG. 10 with handles and a wheel guard removed for clarity, according to the embodiments of the present invention.
Figure 12:
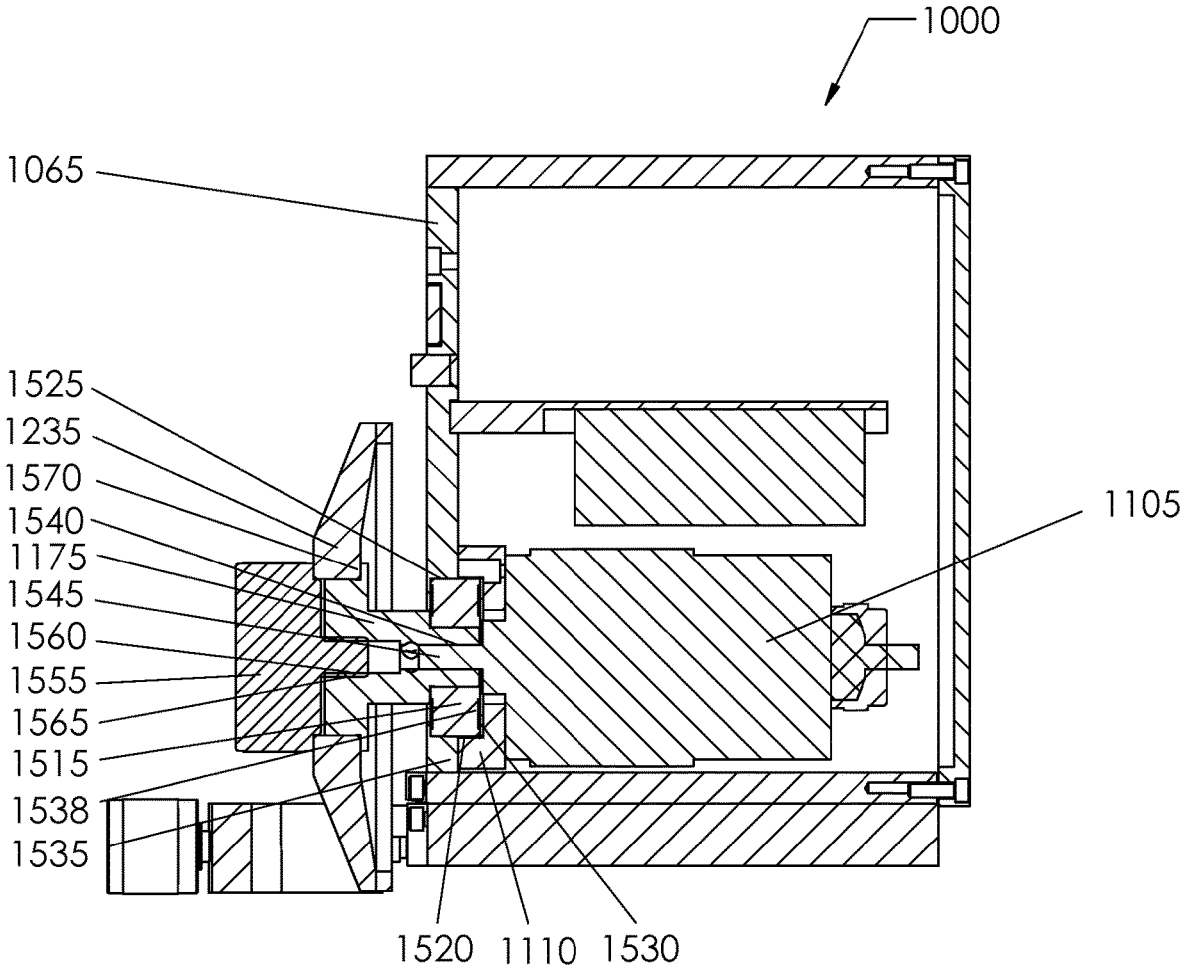
FIG. 12 is a section view of the left side of the ski edge sharpener of FIG. 10 with a battery and wheel guard removed for clarity in showing internal placement of the various components according to the embodiments of the present invention.

In an alternative embodiment, a ski edge sharpener may use a direct drive configuration. For example, FIGS. 10-12 illustrate various views and corresponding components and operation for a direct drive ski edge sharpener 1000. Batteries and/or associating wiring are not shown in FIGS. 10-12 for clarity. The direct drive ski edge sharpener 1000 may include certain features, structural components, and/or operation that are the same as or similar to those previously discussed, such as the ski edge sharpener 10 of FIGS. 1-9. For example, various of the specific components illustrated in FIGS. 1-9 (e.g., a case or paneling, motors such as brushless motors, motor shafts, grinding wheels, edge guides, vacuums or vacuum systems, grinding wheel guards, batteries, tilt plates, base plates, handles, etc.) may be used and/or have the same or similar operation and/or structural configuration as previously shown and/or discussed for FIGS. 1-9, but in a ski edge sharpener having a direct drive configuration, such as the embodiments shown and/or described for FIGS. 10-12.

As illustrated in FIG. 10, a motor 1105 (e.g., a drive motor) is attached (e.g., rigidly attached) to a motor mount 1110. FIG. 11 shows a front view of the ski edge sharpener 1000 of FIG. 10 with handles and a wheel guard removed for clarity and illustrates the section plane from which FIG. 12 is taken. As illustrated, the motor mount 1110 is attached (e.g., rigidly attached) to front plate 1065. With reference to FIGS. 10 and 12, a main bearing 1515 may be inserted into a recess 1520 of the motor mount 1110. The main bearing 1515 may also extend into a recess 1525 of the front plate 1065. A holding component 1530 (e.g., a washer such as a wave spring washer) may operate to hold or aid in holding the main bearing 1515 in position. In one embodiment, the holding component 1530 (e.g., wave spring washer) may be inserted between a surface 1535 of the recess 1520 of the motor mount 1110 and a surface of the main bearing 1515. This holding component 1530 may help in holding the main bearing 1515 against the surface 1535 of the recess 1525 of the front plate 1065.

An arbor 1175 may also be connected with the main bearing 1515. A motor shaft 1545 passes through the main bearing 1515 and engages with (e.g., is inserted into) a rear arbor hole 1540. An arbor set screw 1550 (or other holding element or component) may be used to press against the motor shaft 1545 to help in holding the motor shaft 1545 in place in the arbor 1175. For example, during assembly, the motor shaft 1545 may be pushed forward as the arbor set screw 1550 is tightened to help remove play or other looseness in the motor shaft 1545. One or more threads 1560 of a grinding wheel bolt 1555 may insert and/or engage or tighten with a front opening 1565 (e.g., a threaded front opening) of the arbor 1175, for example, to help hold a grinding wheel 1235 to or in a specific position with respect to the face 1570 (e.g., recessed face) of the arbor 1175. A controller 1575 provides power (e.g., varying power as necessary) to the motor 1105 to help maintain a constant speed or RPM of the motor 1105 (e.g., regardless of the load on the grinding wheel 1235).

While the foregoing written description of the embodiments of the present invention enable one of ordinary skill to make and use what is considered presently to be the best mode thereof, those of ordinary skill will understand and appreciate the existence of variations, combinations, and equivalents of the specific embodiment, method, and examples herein. The invention herein should therefore not be limited by the above-described embodiments, methods, and examples, but by all embodiments and methods within the scope and spirit of the invention as claimed. For example, although specific structural elements in particular configurations are illustrated in the embodiments of any of FIGS. 1-12, alternative structural elements may be used in alternative embodiments, and/or the same or similar structural elements may be configured differently with respect to one another in alternative embodiments.

The invention claimed is:

1. A sharpener for a ski or snowboard comprising:

a motor;

a motor shaft driven by the motor;

a grinding wheel that is directly driven by the motor via direct connection of the motor shaft to the grinding wheel;

a main bearing external to the motor;

a base plate in a first plane adjacent the motor and having a surface that engages the ski or snowboard;

an edge guide proximate to the base plate, the edge guide for guiding the grinding wheel into contact with an edge of a subject ski or snowboard, the edge guide comprising two edge guide surfaces or rollers that engage a side of the ski or snowboard being sharpened and are adjustable laterally towards or away from the side of the edge of the ski or snowboard; and a second plate adjacent and in lateral contact with the base plate, wherein the motor is rigidly mounted to the second plate, the second plate being in a second plane adjacent the first plane and configured to tilt in a first axis to thereby adjust a vertical angle between the grinding wheel and an edge of the ski or snowboard;

wherein movement of the grinding wheel's position is limited to movement in two axes comprised of the first axis, established by rotation of a first plane of the base plate against a second plane of the second plate and defined by a difference in angle between the first plane and the second plane, and a second axis defined by a difference in angle between an instantaneous plane formed by contact points of the two edge guide surfaces or rollers and a plane parallel to a grinding face of the grinding wheel.

2. The sharpener of claim 1 wherein one or both of:

the main bearing being mechanically engaged with an arbor such that grinding forces generated by a load on the grinding wheel during operation and acting to displace the motor shaft or a shaft of the arbor are instead transferred through the arbor to a case or another component that is rigidly attached to the arbor to form a unitary structure with the arbor; and/or the motor, the arbor, and the grinding wheel, together, form a motor-grinding wheel assembly of components rigidly affixed to each other.

3. The sharpener of claim 1, wherein the two edge guide surfaces or rollers are adjustable to move the grinding wheel into lateral engagement with and across a side edge of the ski or snowboard being sharpened.

4. The sharpener of claim 1 wherein the second plate comprises a tilt plate that is coupled to the base plate by one or more hinges comprised of one or more single-piece spring hinges each with a first end rigidly mounted to the tilt plate and an opposing end rigidly mounted to the base plate that have an axis parallel to and on a same side of the ski or snowboard as the edge being sharpened which limit movement of the tilt plate with respect to the base plate except for rotational movement permitted around the axis of the one or more single-piece spring hinges.

5. The sharpener of claim 1 further comprising:

a controller for providing power to the motor, the controller being configured to provide power that is varied to maintain a constant RPM of the motor regardless of load on the grinding wheel.

6. The sharpener of claim 1 further comprising:

a battery connected with the controller, wherein the battery is rechargeable; and a vacuum for collecting grinding residue.

7. The sharpener of claim 1, further comprising the edge guide for guiding an edge of the subject ski or snowboard into contact with the grinding wheel, wherein the edge guide is comprised of edge guide hinges, edge guide hinge return springs, an edge guide slide, and an edge guide adjustment screw, wherein the edge guide is configured to:

adjust a sharpening angle of the subject ski or snowboard in a first plane defined by a vertical face of the base plate and a vertical face of the edge guide; and adjust spacing between a face of the edge guide and a face of the grinding wheel.

8. The sharpener of claim 1, further comprising the edge guide for guiding an edge of the subject ski or snowboard into contact with the grinding wheel, wherein the edge guide comprises one or more edge guide bearings positioned partially within the edge guide and have hardened outer races such that the bearings protect the side edge of the edge guide that engages the ski or snowboard.

9. The sharpener of claim 1, wherein the second plate is coupled to the base plate by a hinge arrangement that includes one or more hinges, such that the second plate is rigidly attached to base plate except for movement allowed by the one or more hinges.

10. The sharpener of claim 1, further comprising:

an arbor, wherein the main bearing is mechanically engaged with the arbor such that grinding forces generated by a load on the grinding wheel during operation and acting to displace the motor shaft are instead transferred through the arbor to a case or another component that is rigidly attached to the arbor to form a unitary structure with the arbor.

11. The sharpener of claim 10, wherein the motor, the arbor, and the grinding wheel, together, form an assembly of components rigidly affixed to each other.

12. A sharpener comprising:

a base plate defining a first plane;

a motor positioned at least partially within a case adjacent the base plate;

a motor shaft engaged with the motor;

a grinding wheel that is directly driven by the motor via direct connection of the motor shaft to the grinding wheel;

a main bearing external to the motor; and a tilt plate adjacent and proximate to the base plate and supporting the case, a first edge of the tilt plate selectively movable about a first edge of the base plate such that an angle between the tilt plate and the base plate and a vertical angle between the grinding wheel and an edge of the subject ski or snowboard may be selectively adjusted and set; and one or more of:

wherein the case and the motor are rigidly attached to the tilt plate, which enables precise control of the grinding wheel's engagement of the edge of the ski or snowboard based on the angle between the tilt plate and the base plate, the vertical angle between the grinding wheel and the ski edge, and a horizontal angle between the grinding wheel and the ski edge;

wherein the tilt plate is coupled to the base plate by a hinge arrangement that includes one or more hinges, such that the tilt plate is rigidly attached to base plate except for movement allowed by the one or more hinges;

wherein the motor shaft, the arbor, and the grinding wheel are rigidly attached to form an assembly that is mounted as a unit positioned in a second plane arranged to have a shared axis with the first plane, the second plane being coaxial with a first axis of the motor shaft, the arbor, and the grinding wheel;

wherein the assembly and second plane are configured in a rotating arrangement with the base plate and first plane such that the assembly and the base plate pivot along a second axis that serves as a fixed point of rotation between the first plane of the base plate and the second plane associated with the assembly, and thereby enable the assembly to pivot, via the second plane, in a repeatable angular relationship with the base plate via the first plane in only established planar angles defined by the pivot.

13. A sharpener for a ski or snowboard comprising:

a base plate defining a first plane;

a motor positioned at least partially within a case adjacent the base plate;

a motor shaft engaged with the motor;

a grinding wheel that is directly driven by the motor via direct connection of the motor shaft to the grinding wheel;

a main bearing external to the motor;

a tilt plate adjacent and proximate to the base plate and supporting the case, a first edge of the tilt plate selectively movable about a first edge of the base plate such that an angle between the tilt plate and the base plate and a vertical angle between the grinding wheel and an edge of the subject ski or snowboard may be selectively adjusted and set; and a slide movable into stepped slots to permit selective adjustment of the angle between the tilt plate and the base plate;

wherein the motor shaft, the arbor, and the grinding wheel are rigidly attached to form an assembly that is mounted as a unit positioned in a second plane arranged to have a shared axis with the first plane, the second plane being coaxial with a first axis of the motor shaft, the arbor, and the grinding wheel;

wherein the assembly and second plane are configured in a rotating arrangement with the base plate and first plane such that the assembly and the base plate pivot along a second axis that serves as a fixed point of rotation between the first plane of the base plate and the second plane associated with the assembly, and thereby enable the assembly to pivot, via the second plane, in a repeatable angular relationship with the base plate via the first plane in only established planar angles defined by the pivot.

14. The sharpener of claim 13 wherein the main bearing is mechanically engaged with the motor shaft, the motor and the case such that grinding forces generated by load on the grinding wheel during operation and acting to displace the motor shaft are instead transferred to the case.

15. The sharpener of claim 13 further comprising:

an edge guide proximate to the base plate, the edge guide for guiding an edge of a subject ski or snowboard into contact with the grinding wheel.

16. A sharpener for a ski or snowboard comprising:

a base plate defining a first plane;

a motor positioned at least partially within a case adjacent the base plate;

a motor shaft engaged with the motor;

a grinding wheel that is directly driven by the motor via direct connection of the motor shaft to the grinding wheel;

a main bearing external to the motor;

a tilt plate adjacent and proximate to the base plate and supporting the case, a first edge of the tilt plate selectively movable about a first edge of the base plate such that an angle between the tilt plate and the base plate and a vertical angle between the grinding wheel and an edge of the subject ski or snowboard may be selectively adjusted and set; and a tilt angle lock down fastener or screw for setting the angle between the tilt plate and the base plate;

wherein the motor shaft, the arbor, and the grinding wheel are rigidly attached to form an assembly that is mounted as a unit positioned in a second plane arranged to have a shared axis with the first plane, the second plane being coaxial with a first axis of the motor shaft, the arbor, and the grinding wheel;

wherein the assembly and second plane are configured in a rotating arrangement with the base plate and first plane such that the assembly and the base plate pivot along a second axis that serves as a fixed point of rotation between the first plane of the base plate and the second plane associated with the assembly, and thereby enable the assembly to pivot, via the second plane, in a repeatable angular relationship with the base plate via the first plane in only established planar angles defined by the pivot.

17. The sharpener of claim 16 further comprising a grinding wheel guard and vacuum assembly surrounding the grinding wheel for collecting grinding residue.

18. A sharpener for a ski or snowboard comprising:

a base plate defining a first plane;

a motor positioned at least partially within a case adjacent the base plate;

a motor shaft engaged with the motor;

a grinding wheel that is directly driven by the motor via direct connection of the motor shaft to the grinding wheel;

a main bearing external to the motor;

an edge guide proximate to the base plate, the edge guide for guiding an edge of a subject ski or snowboard into contact with the grinding wheel; and an edge guide slide positioned within an edge guide slot, wherein the edge guide slide is configured to adjust an angle between vertical co-planar surfaces of the edge guide and the base plate;

wherein the motor shaft, the arbor, and the grinding wheel are rigidly attached to form an assembly that is mounted as a unit positioned in a second plane arranged to have a shared axis with the first plane, the second plane being parallel and coaxial with a first axis of the motor shaft, the arbor, and the grinding wheel;

wherein the assembly and second plane are configured in a rotating arrangement with the base plate and first plane such that the assembly and the base plate pivot along a second axis that serves as a fixed point of rotation between the first plane of the base plate and the second plane associated with the assembly, and thereby enable the assembly to pivot, via the second plane, in a repeatable angular relationship with the base plate via the first plane in only established planar angles defined by the pivot.

19. The sharpener of claim 18, further comprising an adjustment screw associated with the edge guide slide, the adjustment screw passing through the edge guide slot in an edge guide slide and into the edge guide for setting the angle between vertical co-planar surfaces of the edge guide and the base plate.

20. The sharpener of claim 18, wherein the main bearing is mechanically engaged to the motor such that grinding forces generated by a load on the grinding wheel during operation and acting to displace the motor shaft are instead transferred to the case or another component that is rigidly attached to the arbor to form a unitary structure with the arbor.

21. The sharpener of claim 18, wherein a second plate is coupled to the base plate by a hinge arrangement that includes one or more hinges, such that the second plate is rigidly attached to base plate except for movement allowed by the one or more hinges.

22. The sharpener of claim 18, further comprising:

a tilt plate that is coupled to the base plate by one or more hinges each with a first end rigidly mounted to the tilt plate and an opposing end rigidly mounted to the base plate that have an axis parallel to and on a same side of the ski or snowboard as the edge being sharpened which limit movement of the tilt plate with respect to the base plate except for rotational movement permitted around the axis of the one or more hinges.

23. The sharpener of claim 18, further comprising:

two edge guide surfaces or rollers that are adjustable to move the grinding wheel into lateral engagement with and across a side edge of the ski or snowboard being sharpened.

24. The sharpener of claim 18, wherein the edge guide is configured to:

adjust angulation of sharpening of the subject ski or snowboard in a first plane defined by a vertical face of the base plate and a vertical face of the edge guide; and adjust spacing between a surface of the edge guide and a face of the grinding wheel.

* * * * *